United States Patent [19]

Sakurai

[11] Patent Number: 4,656,911

[45] Date of Patent: Apr. 14, 1987

[54] AUTOMATIC RHYTHM GENERATOR FOR ELECTRONIC MUSICAL INSTRUMENT

[75] Inventor: Keiichi Sakurai, Tokyo, Japan

[73] Assignee: Casio Computer Co., Ltd., Tokyo, Japan

[21] Appl. No.: 709,539

[22] Filed: Mar. 8, 1985

[30] Foreign Application Priority Data

Mar. 15, 1984 [JP] Japan ..... 59-48082
May 24, 1984 [JP] Japan ..... 59-105507

[51] Int. Cl.[4] ..... G10H 1/38; G10H 7/00

[52] U.S. Cl. ..... 84/1.03; 84/DIG. 12; 84/DIG. 22

[58] Field of Search ..... 84/1.03, DIG. 12, DIG. 22

[56] References Cited

U.S. PATENT DOCUMENTS 3,958,483 5/1976 Borrevick et al. ..... 84/1.03
4,171,658 10/1979 Aoki et al. ..... 84/DIG. 22

FOREIGN PATENT DOCUMENTS 044945 2/1982 European Pat. Off. .
2905222 9/1979 Fed. Rep. of Germany .

*Primary Examiner*—S. J. Witkowski
*Assistant Examiner*—David Warren
*Attorney, Agent, or Firm*—Frishauf, Holtz, Goodman & Woodward

[57] ABSTRACT

Every time a new chord signal is supplied to a chord memory circuit, a previous chord signal is supplied to a chord comparison and calculation circuit together with the new chord signal to obtain a chord change signal representing a degree of change between the two sequentially designated chords. The chord change signal is stored in chord change memory circuits. Chord same signals and chord change signals are compared with chord change pattern signals outputted from a change pattern memory to cause a coincidence signal to hold a latch. A rhythm pattern selection signal thus is supplied from the latch to a rhythm pattern memory circuit.

7 Claims, 9 Drawing Figures

FIG. 3

| CHORD | D6 | D5 | D4 |
|---|---|---|---|
| NON | 0 | 0 | 0 |
| MAJ | 0 | 0 | 1 |
| MIN | 0 | 1 | 0 |
| 7TH | 0 | 1 | 1 |
| MIN 7 | 1 | 0 | 0 |
| SUS 4 | 1 | 0 | 1 |
| MAJ 7 | 1 | 1 | 0 |
| AUG | 1 | 1 | 1 |

FIG. 4

| ROOT | D3 | D2 | D1 | D0 |
|---|---|---|---|---|
| C | 0 | 0 | 0 | 0 |
| C# | 0 | 0 | 0 | 1 |
| D | 0 | 0 | 1 | 0 |
| D# | 0 | 0 | 1 | 1 |
| E | 0 | 1 | 0 | 0 |
| F | 0 | 1 | 0 | 1 |
| F# | 0 | 1 | 1 | 0 |
| G | 0 | 1 | 1 | 1 |
| G# | 1 | 0 | 0 | 0 |
| A | 1 | 0 | 0 | 1 |
| A# | 1 | 0 | 1 | 0 |
| B | 1 | 0 | 1 | 1 |

FIG. 5

| PATTERN (CHANGE) | RHYTHM | S3 | S2 | S1 |
|---|---|---|---|---|
| MAJ —— I2 | 4 VAR. | 0 | 0 | 1 |
| MIN —— I7 | 4 VAR. | 0 | 1 | 0 |
| MAJ —— IV —— V | FILL IN | 0 | 1 | 1 |
| MAJ —— II5 | FILL IN | 1 | 0 | 0 |

FIG. 8

| MEASURE | 1 | 2 | 3 | 4 | 5 | 6 | 7 | 8 |
|---|---|---|---|---|---|---|---|---|
| CHORD | C-MAJ | E-MAJ | F-MAJ | G7 | C7 | D7 | G7 | C-MAJ |

FIG. 9

| SIGNAL | | DIGITAL VALUE |
|---|---|---|
| CD 1 | MAJ | 001 |
| DV 2 | C−G | 0101(12) |
| KD 2 | 7TH | 011 |
| DV 3 | C−D | 0101(12) |
| KD 3 | 7TH | 011 |
| DV 7 | C−C | 0000(12) |
| CD 7 | MAJ | 001 |

AUTOMATIC RHYTHM GENERATOR FOR ELECTRONIC MUSICAL INSTRUMENT

BACKGROUND OF THE INVENTION

The present invention relates to an automatic rhythm generator for an electronic musical instrument to provide automatic rhythm performance in accordance with chord performance.

According to a first conventional automatic rhythm generator, rhythm performance based upon a fill-in rhythm pattern is periodically made in place of rhythm performance based upon a normal rhythm pattern, thereby realizing the rhythm performance with much variety.

According to a second conventional rhythm pattern generator, when a manner of playing at a keyboard changes within a predetermined time interval, the rhythm performance is continued in accordance with the normal rhythm pattern. However, when the playing manner at the keyboard does not change within the predetermined time interval, the rhythm performance is performed with the fill-in rhythm pattern.

According to a third conventional rhythm pattern generator, a rhythm pattern is varied by a variation switch. In addition, even if the variation switch is not operated, a variation pattern is automatically generated when a chord continues for a long time interval.

In the first conventional automatic rhythm generator, the fill-in rhythm is automatically inserted irrespective of the contents of a musical piece. The fill-in rhythm cannot be inserted in a correct position or in a desired position. As a result, the melody part often cannot be harmonized with the rhythm section.

In the second and third conventional automatic rhythm generators, a single chord is rarely played for a long time interval, and a practical effect cannot be obtained.

SUMMARY OF THE INVENTION

It is an object of the present invention to provide an automatic rhythm generator for an electronic musical instrument, wherein a rhythm pattern naturally changes to a harmoneous one in accordance with a change in chord performance.

According to an aspect of the present invention, there is provided an automatic rhythm generator for an electronic musical instrument, comprising: an accompaniment keyboard; a chord discrimination signal generator for generating a chord discrimination signal for a chord designated by the accompaniment keyboard; a chord change memory circuit for detecting the chord discrimination signal and sequentially storing a degree of change between the chord discrimination signal of the currently designated chord and a chord discrimination signal of an immediately preceding chord; a chord change pattern memory circuit for storing a plurality of chord change patterns; a rhythm pattern change circuit for changing the rhythm pattern in accordance with the memory contents of the chord change memory circuit and the chord change pattern memory circuit; and means for producing rhythm tones in accordance with the rhythm pattern changed by the rhythm pattern change circuit.

According to another aspect of the present invention, there is provided an automatic rhythm generator for an electronic musical instrument, comprising: an accompaniment keyboard; a chord discrimination signal generator for generating a chord discrimination signal for a chord designated by the accompaniment keyboard; a first chord change memory circuit for detecting the chord discrimination signal and sequentially storing a degree of change between the chord discrimination signal of the currently designated chord and a chord discrimination signal of an immediately preceding chord; a second chord change memory circuit for storing a degree of change between the chord discrimination signal of the currently designated chord and a chord discrimination signal of a chord designated before a predetermined time interval; a chord change pattern memory circuit for storing a plurality of chord change patterns; a rhythm pattern change circuit for changing the rhythm pattern in accordance with the memory contents of the first and second chord change memory circuits and the chord change pattern memory circuit; and means for producing rhythm tones in accordance with the rhythm pattern changed by the rhythm pattern change circuit.

BRIEF DESCRIPTION OF THE DRAWINGS

FIGS. 3 and 4 are tables showing chord name and root data, respectively;

FIG. 5 is a table showing the relationship between pattern change and rhythm content;

FIG. 8 is a table showing a practical example of chord change; and

FIG. 9 is a table showing the contents of the input data to a chord comparator.

DETAILED DESCRIPTION OF THE PREFERRED EMBODIMENTS

Preferred embodiments of the present invention will be described in detail with reference to the accompanying drawings. An automatic rhythm generator according to a first embodiment will be described with reference to FIGS. 1 to 5.

Figure 1:
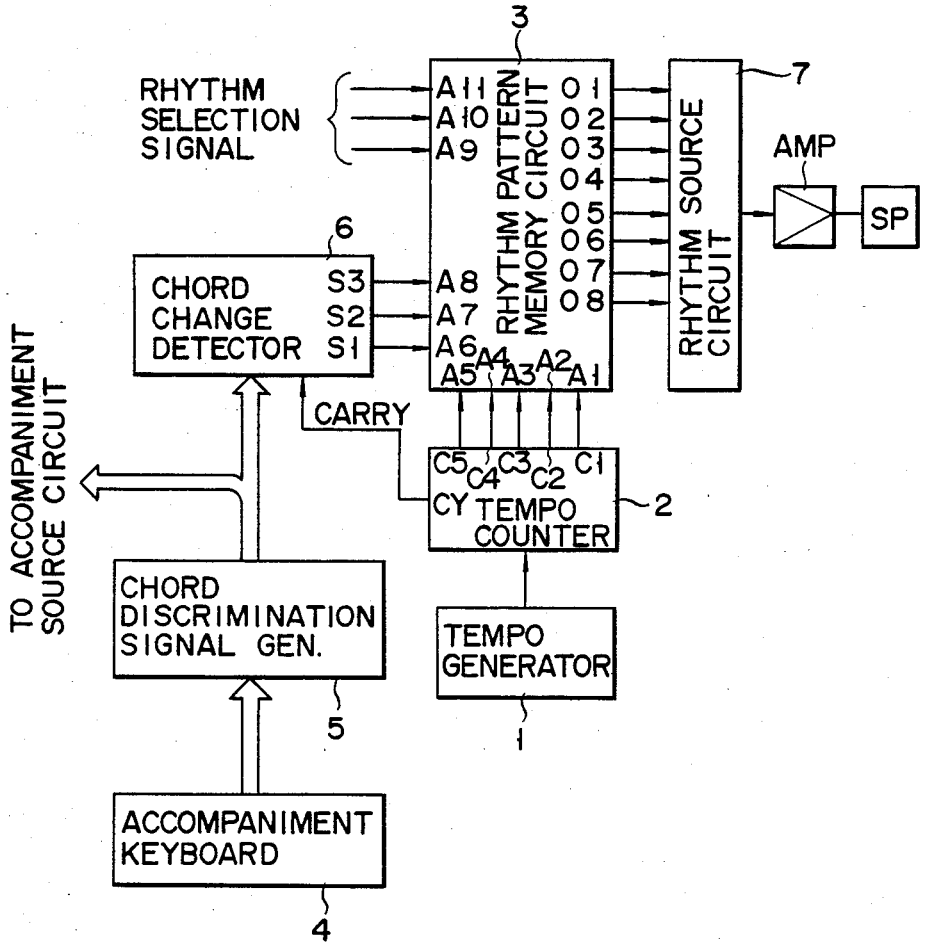
FIG. 1 is a block diagram of an automatic rhythm generator according to an embodiment of the present invention.

Referring to FIG. 1, a tempo generator 1 generates a tempo clock having a frequency corresponding to a desired level of a tempo volume control (not shown). The tempo clock is supplied to a tempo counter 2. Output signals C1 to C5 from the counter 2 are supplied to address input terminals A1 to A5 of a rhythm pattern memory circuit 3, respectively. An accompaniment keyboard 4 has a plurality of keys and produces a chord signal upon simultaneous depression of a plurality of keys.

Outputs from the depressed keys of the keyboard 4 are converted by a chord discrimination signal generator 5 to a chord discrimination signal representing, e.g., Cmaj, D7 or Fmin. The chord discrimination signal is supplied to a chord change detector 6 and an accompaniment source circuit (not shown). The chord discrimination signal is formed of 7 bits D6 to D0, as shown in FIGS. 3 and 4. The upper three bits D6 to D4 represent a chord name, as shown in FIG. 3. The lower four bits D3 to D0 represent a root name, as shown in FIG. 4.

The detector 6 detects a chord change in accordance with a change in content of the chord discrimination signal. Detection signal bits from the detector 6 are supplied from output terminals S1, S2 and S3 thereof to address input terminals A6, A7 and A8 of the memory circuit 3 to change address designation of a regular rhythm pattern to a fill-in or variation rhythm pattern. A carry signal generated from the counter 2 at each bar line cancels a change in pattern.

Address input terminals A9, A10 and A11 of the memory circuit 3 receive a rhythm selection signal (3 bits) representing rock'n roll, waltz or the like designated by a rhythm selection switch (not shown). Rhythm pattern data accessed by the input signal to the terminals A1 to A11 among a plurality of rhythm pattern data stored in the memory 3 is read out from output terminals O1 to O8. The readout rhythm pattern data drives a rhythm source such as drums, conga or cymbals in a rhythm source circuit 7. Each rhythm source signal is produced as a rhythm accompaniment tone through an amplifier AMP and a loudspeaker SP.

Figure 2:
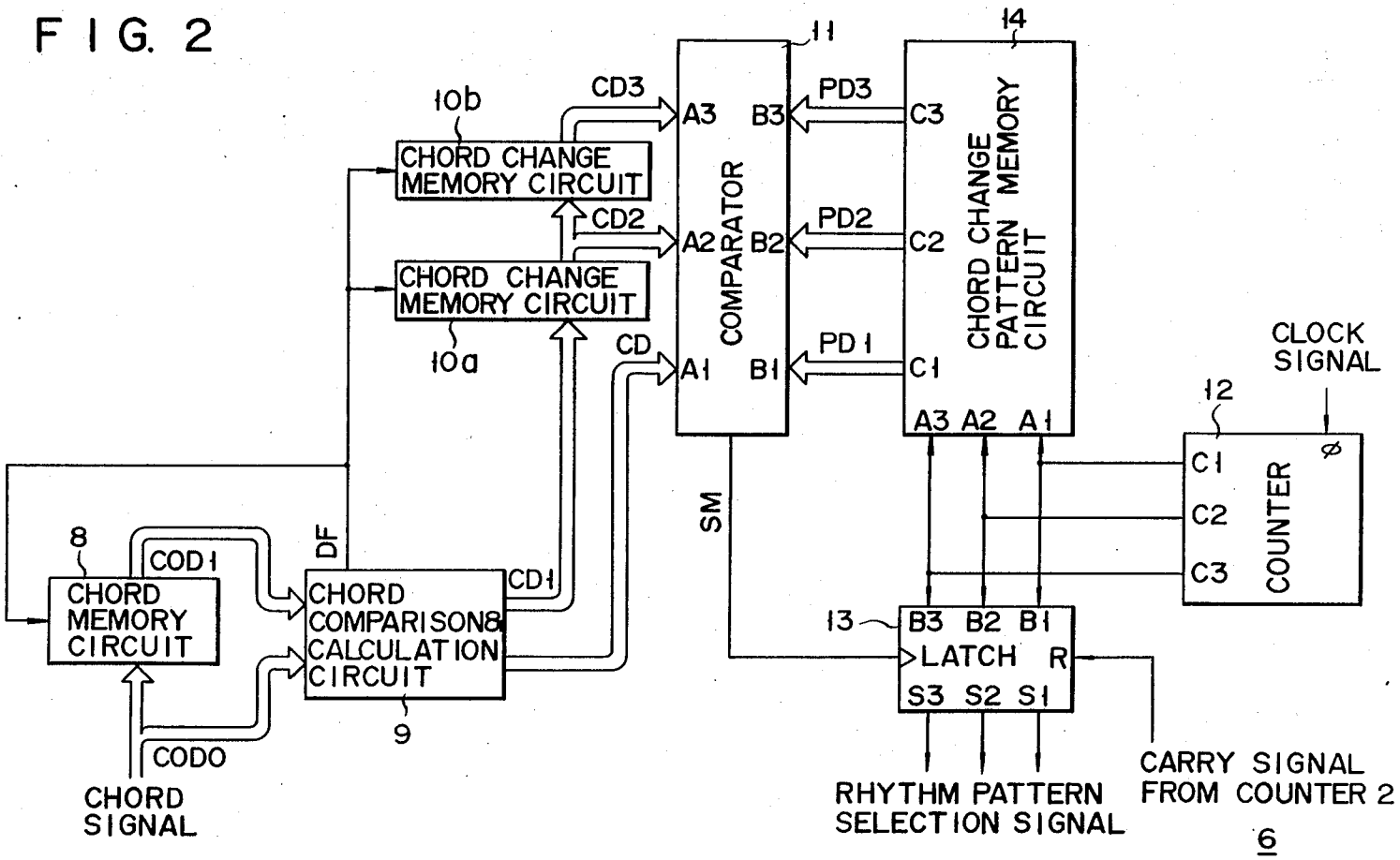
FIG. 2 is a block diagram of a chord change detector shown in FIG. 1.

A detailed circuit arrangement of the chord change detector 6 will be described with reference to FIG. 2. Referring to FIG. 2, a chord memory circuit 8 receives the chord discrimination signal as a current chord signal C0D0. A chord signal C0D1 from the memory circuit 8 is a previously designated chord signal. The signals C0D0 and C0D1 are supplied to a chord comparison & calculation circuit 9 which calculates a difference between the signals C0D0 and C0D1 to derive a chord change signal CD1. The signal CD1 is supplied to a chord change memory circuit 10*a*. The circuit 9 selects a chord name from the current chord signal C0D0 and generates a chord signal CD representing the chord name. The signal CD is supplied to the terminal A1 of a comparator 11. The circuit 9 also generates a "1" level signal DF when the value of the signal CD1 is not zero. The signal DF is supplied to the memory circuits 8 and 10*a*, and to a chord change memory circuit 10*b* so as to control the write operation of these circuits.

The memory circuit 10*b* is set to store a chord change signal CD2 generated from the memory circuit 10*a*. The circuit 10*b* also generates a chord change signal CD3. The signals CD2 and CD3 are signals representing the differently previous chord change and respectively are supplied to input terminals A2 and A3 of the comparator 11.

A counter 12 is driven by a high-speed clock $\phi$. A count output from the counter 12 appears at output terminals C1, C2 and C3 thereof and is supplied to input terminals B1, B2 and B3 of a latch 13 and input terminals A1, A2 and A3 of a chord change pattern memory circuit 14. The memory circuit 14 stores eight chord change patterns. Pattern data appears at output terminals C1, C2 and C3 of the memory circuit 14 in response to an input to the terminals A1, A2 and A3 thereof. The pattern data bits are generated as PD1, PD2 and PD3 which are respectively supplied to input terminals B1, B2 and B3 of the comparator 11. The comparator 11 compares input data to the terminals A1 to A3 with that to the terminals B1 to B3. When a coincidence between these input data is established, the comparator 11 generates a "1" coincidence signal SM. The signal SM is supplied to the latch 13 which then performs latching of the data supplied to input terminals B1 to B3. The latched data from the latch 13 appears as a rhythm pattern selection signal at output terminals S1, S2 and S3 thereof. The bits of this rhythm pattern selection signal are supplied to the terminals A6 to A8 of the memory circuit 3.

The operation of the automatic rhythm generator of the first embodiment will be described hereinafter. A player operates a rhythm selection switch (not shown) to select one of rhythms such as rock'n roll or waltz prior to automatic rhythm performance. The generated 3-bit rhythm selection signal is supplied to the terminals A9 to A11 of the memory circuit 3. When the player depresses a rhythm start button (not shown), automatic performance is commenced. The generator 1 supplies the tempo clock to the counter 2. The count output from the counter 2 is supplied to the terminals A1 to A5 of the circuit 3.

The player produces a chord at the keyboard 4 in synchronism with automatic rhythm performance. Meanwhile, the outputs from the depressed keys are supplied to the generator 5 which generates the corresponding chord signal C0D0. The signal C0D0 is supplied to the circuits 8 and 9 in the detector 6 and to an accompaniment source circuit (not shown), thereby producing a chord.

The circuit 9 also receives the signal C0D1 previously stored in the memory circuit 8. The circuit 9 compares the current signal C0D0 with the previous signal C0D1 to derive a difference as the signal CD1. The signal CD of the signal C0D0 which represents a chord name is supplied to the terminal A1 of the comparator 11. When the signal CD1 is not set at logic "0", i.e., when the previous signal C0D1 differs from the current signal C0D0, the calculation circuit 9 generates the signal DF which drives the memory circuits 8, 10*a* and 10*b*. Since the current signal C0D0 is stored in the circuit 8, its storage content is updated to the signal C0D1. After the signal CD1 (i.e., difference data) is stored in the circuit 10*a*, its storage content is updated to the signal CD2. Similarly, the signal CD2 stored in the circuit 10*a* is stored in the circuit 10*b* and is updated to the signal CD3 (i.e., difference data). The signals CD2 and CD3 are supplied to the terminals A2 and A3 of the comparator 11, respectively.

The comparator 11 compares the signals CD, CD2 and CD3 input to the terminals A1, A2 and A3 thereof with the signals PD1, PD2 and PD3 input to the terminals B1, B2 and B3, respectively. When a coincidence is established between these input signals, the comparator 11 generates the signal SM. At the same time, the current count output from the counter 12 is latched by the latch 13. The latched data is supplied from the terminals S1 to S3 as a rhythm pattern selection signal to the terminals A6, A7 and A8 of the circuit 3. Until the latch 13 is reset in response to the next carry signal from the counter 2, fill-in or variation pattern data instead of the normal rhythm pattern data is read out from the terminals O1 to O8 of the circuit 3. The readout rhythm pattern data is supplied to the circuit 7. During this period of time, the fill-in or variation rhythm pattern is automatically played instead of the normal rhythm pattern.

The operation of the chord change detector 6 will be described in more detail by exemplifying a chord change. Assume that the current chord signal C0D0 represents D♯maj and the previous chord signal C0D1 represents Daug. Under these assumptions, the following relations are derived from FIGS. 3 and 4:

D#maj→0010011

Daug→1110010

The difference data (i.e., the signal CD1) from the circuit 9 is given as follows:

$$\begin{array}{rrrl} & 001 & 0011 & (D^{\#}maj) \\ - & 111 & 0010 & (Daug) \\ \hline & 010_{(8)} & 0001_{(12)} & (I_2) \end{array}$$

where letter I of $I_2$ represents a root difference, number 2 thereof represents the chord difference, (8) represents that a calculation is performed by octal notation, and (12) represents that a calculation is performed by duodecimal notation.

In the chord comparison calculation described above, the signals CD and CD2 represent a major chord and the chord change pattern $I_2$, respectively (the signal CD3 has any value). When the "1" signal SM is generated from the comparator 11, the count output "001" from the counter 12 is latched by the latch 13 and is generated as the rhythm pattern selection signal from the terminals S3, S2 and S1, as shown in the first row of the table in FIG. 5. The data "001" is supplied to the terminals A8, A7 and A6 of the memory circuit 3. Therefore, 4 Var. (variation) rhythm pattern data instead of the normal rhythm pattern data is read out from the circuit 3.

Similarly, as shown in the second, third and fourth rows of FIG. 5, when the pattern changes are given as min-$I_7$, Maj-IV-V, and Maj-$II_5$, the rhythm pattern selection signals (S3S2S1) are given as "010", "011" and "100", so that 4 Var., fill-in and fill-in rhythm pattern data are read out, respectively. Although not shown in FIG. 5, when the rhythm pattern selection signals (S3S2S1) are given as "101", "110", "111" and "000", another 4 rhythm pattern data of variation and fill-in rhythm pattern data are read out, respectively.

Figure 6:
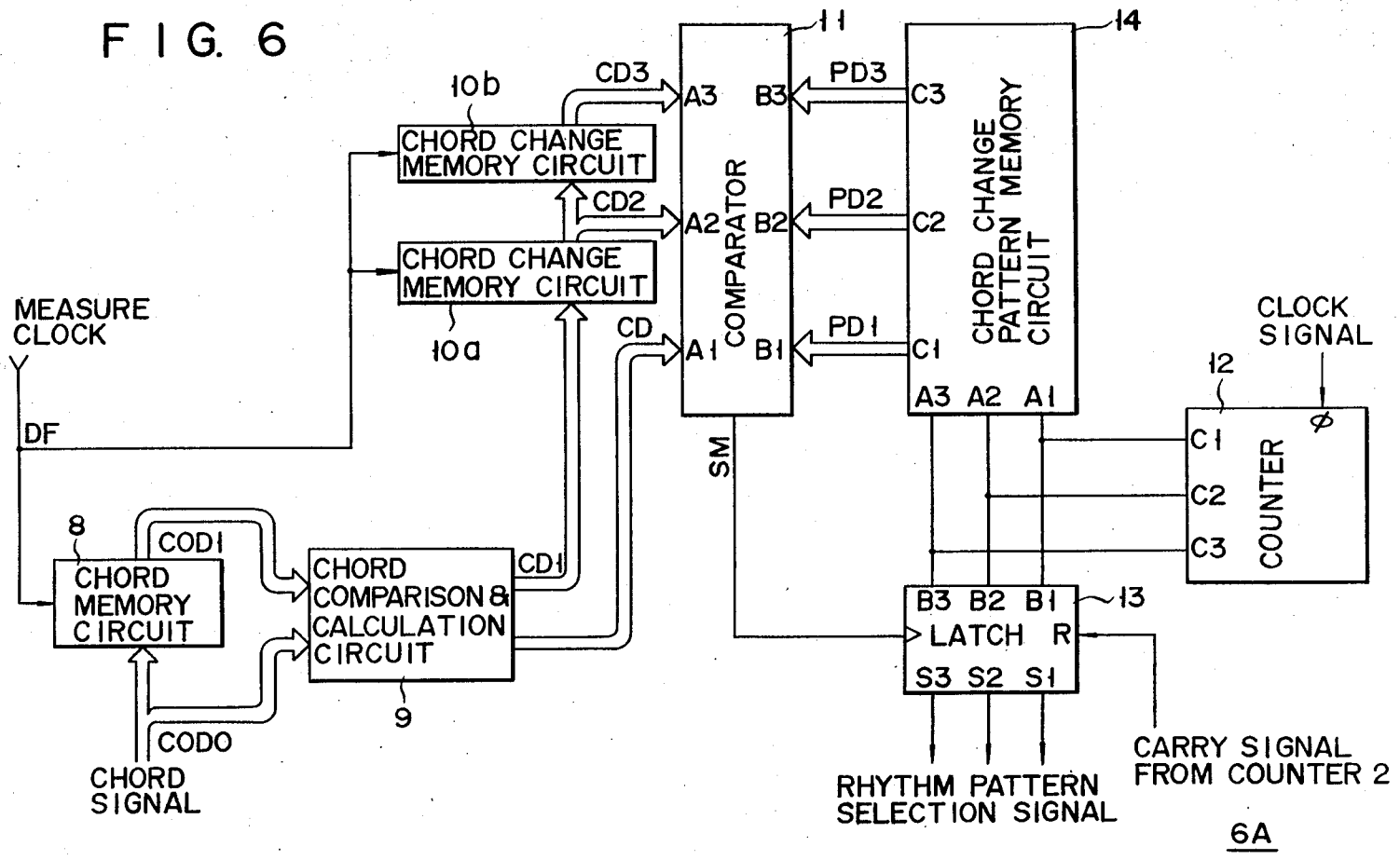
FIG. 6 is a block diagram of a chord change detector used in another embodiment of the present invention.

FIG. 6 shows a chord change detector 6A used in an automatic rhythm generator according to a second embodiment of the present invention. In the second embodiment, a measure clock, i.e., the carry signal from the tempo counter 2 is used as the signal DF of the first embodiment. Other arrangements of the second embodiment are the same as those of the first embodiment. Therefore, in the second embodiment, chord change detection can be performed in units of measures. The operation of the second embodiment is the same as that of the first embodiment except for the use of the measure clock as the signal DF.

In the first and second embodiments, the chord change pattern is determined by a root name and a chord name when a rhythm pattern is to be changed, so that precise chordal change can be detected. The pattern of a rhythmic tone can vary in accordance with the detected chord change pattern, thereby improving the musical effect.

The rhythm pattern is determined in accordance with the current chord and the immediately preceding chord, or the current chord and the two immediately preceding chords. However, rhythm pattern designation is not limited to such a method. A rhythm pattern can be determined in accordance with four or more chords.

The change in chord is determined in accordance with the root name and the chord name. However, the change may be determined by only the chord name. It is essential to sequentially detect the degrees of change in chord discrimination signals and to store values corresponding to the degrees. The rhythm pattern can be changed in accordance with the stored values.

As described above, the degrees of change in chord discrimination signals are sequentially detected and stored, and a predetermined chord change pattern memory circuit is arranged to provide an automatic rhythm generator for an electronic musical instrument so as to change the rhythm pattern in accordance with the chord change pattern, thereby naturally changing the rhythm pattern and providing a variety of rhythm patterns.

In still another embodiment of the present invention, the same effect as the previous embodiment can be obtained by the following arrangement. The degrees of change in chord discrimination signals are sequentially detected and stored upon key operations of the accompaniment keyboard. A degree of a change from the previous chord discrimination signal designated a predetermined period of time prior to the current chord discrimination signal is detected. In addition, a chord change pattern memory circuit is provided for storing chord change patterns, thereby changing the rhythm pattern in accordance with the chord change pattern.

Figure 7:
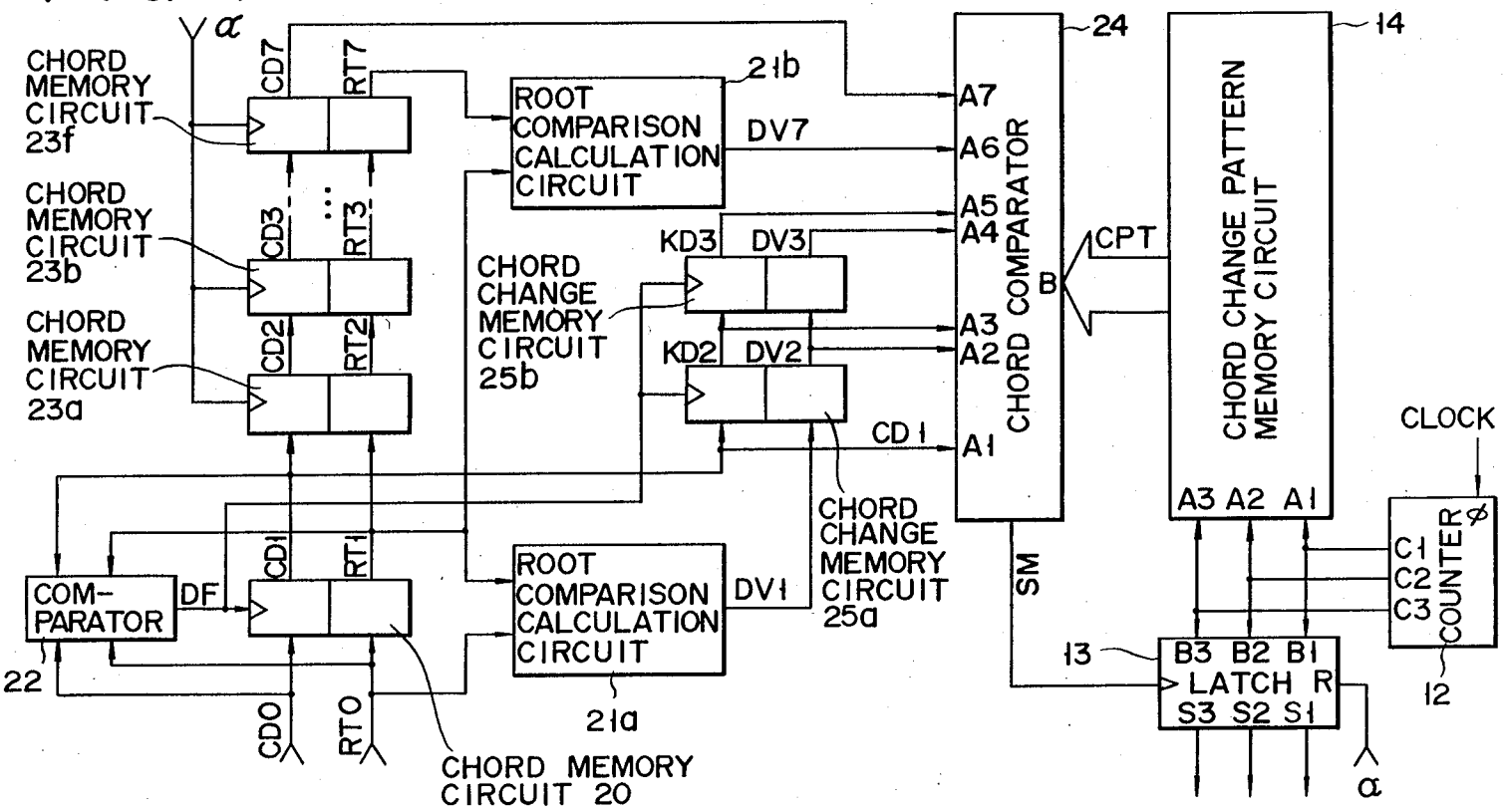
FIG. 7 is a block diagram of a chord change detector used in still another embodiment of the present invention.

The same reference numerals in FIG. 7 denote the same parts as in FIG. 2, and a detailed description thereof will be omitted.

Referring to FIG. 7, a current chord discrimination signal consisting of a chord name signal CD0 and a root name signal RT0 is supplied from a chord discrimination signal generator such as the generator 5 as shown in FIG. 1 to a chord memory circuit 20. The signal RT0 is also supplied to a root comparison calculation circuit 21*a* and a comparator 22. The comparator 22 also receives the signal CD0. The circuit 20 produces a previous chord name signal CD1 and a previous root name signal RTl. The signal RT1 is supplied to the circuit 21*a*, a chord memory circuit 23*a* and the comparator 22. The signal CD1 is supplied to an input terminal A1 of a chord comparator 24, a chord change memory circuit 25*a*, the circuit 23*a* and the comparator 22. The comparator 22 compares the current chord signal with the output from the circuit 20. When a difference between these signals is detected, the comparator 22 generates a signal DF. The signal DF is supplied as a write enable signal to the circuits 20, 25*a*, and 25*b*. The circuit 21*a* calculates a difference between the current root name signal and the signal RT1 and generates a root name change signal DV1. The signal DV1 is supplied to the circuit 25*a*. When the signals DV1 and CD1 are stored in the memory 25*a* in response to the signal DF, the outputs thereof are updated to signals DV2 and KD2. The signals DV2 and KD2 are supplied to input terminals A2 and A3 of the comparator 24, respectively. The circuit 25*b* is set in the write mode in response to the signal DF. An output from the circuit 25*b* is supplied to input terminals A4 and A5 of the comparator 24. The output signals RT2 and CD2 from the circuit 23*a* are supplied to the next circuit 23*b*. The circuit 23*b* generates signals RT3 and CD3. The chord memory circuit network comprises seven chord memory circuits 20, 23*a* to 23*f*. Output signals RT7 and CD7 from a last chord memory circuit 23*f* are supplied to a root comparison calculation circuit 21*b* and an input terminal A7 of the comparator 24, respectively. The circuits 23*a* to 23*f* are set in the write mode in response to a clock $\alpha$ generated for every measure. The circuit 21*b* receives the signals RT1 and RT7 and calculates a difference between the signals RT1 and RT7. The circuit 21*b* generates the root name change signal DV7 which is then supplied to an input terminal A6 of the comparator 24.

A counter 12 is driven in response to a high-speed clock $\phi$. A count output from the counter 12 appears at output terminals C1, C2 and C3 thereof and is supplied to input terminals B1, B2 and B3 of a latch 13 and to input terminals A1, A2 and A3 of the memory 14, respectively. The chord change pattern memory circuit 14 stores eight chord change patterns. The circuit 14 generates pattern data CPT in correspondence to an input to the input terminals A1, A2 and A3 and supplies the data CPT to the input terminal B of the chord comparator 24. The chord comparator 24 compares the data at the input terminals A1 to A7 and B, and when coincident, it generates the "1" coincidence signal SM to the latch 13 which performs the latch operation. The latch data from the latch 13 is generated as a rhythm pattern selection signal from the output terminals S1, S2 and S3 and is supplied to the address input terminals A6 to A8 of the rhythm pattern memory circuit as shown in FIG. 3.

Operation of the above embodiment will be described hereinafter. Main operation of the embodiment will first be described. According to this embodiment, in order to discriminate a chord pattern, a change in chord names of the current chord and two immediately preceding chords are sequentially detected. Furthermore, the degree of change between the root of the current chord and that of the seventh preceding measure and a name thereof are detected. In this manner, assume that the following chord changes (a) and (b) are made in two different musical keys:

(a) D7→G7→Cmaj (Cmaj)

(b) B7→E7+Amaj (Amaj)

In this case, degrees of the above two chord changes are the same. Therefore, the fill-in rhythm is generated instead of the normal rhythm pattern. However, assume that the chord change is made as follows:

(c) A7→D7+Gmaj (Cmaj)

The degree of chord change is the same as the above chord change. However, in this case, the fill-in rhythm sometimes must not be generated. Generally, a musical piece is constituted based upon a unit of eight measures, and chords are also constituted based upon a unit of eight measures. For this reason, the last chord is designated as a resolution chord and the key of each the eight measures is mainly controlled by the first chord. Therefore, when a difference between the current chord and the seventh preceding chord is detected, the above problem can be resolved.

Prior to the automatic rhythm performance, any one of rhythm patterns such as rock'n roll, waltz, and the like is designated by operating the rhythm selection switch. Thus, the rhythm pattern selection signal is supplied to the address input terminals A9 to A11 of the rhythm pattern memory circuit 3 shown in FIG. 1. When the rhythm start button is turned on, the automatic rhythm performance starts, and the tempo generator 1 supplies a clock to the counter 2 so as to drive it. Therefore, a count output of the counter 2 is supplied to the address input terminals A1 to A5 of the circuit 3.

On the other hand, a chord accompaniment is manually made by using the accompaniment keyboard 4 so as to correspond to the rhythm performance. In this case, outputs from respective keys are supplied to the chord discrimination signal generator 5 and are converted into the signals RT0 and CD0 representing the root and name of the corresponding chord. These signals RT0 and CD0 are supplied to the chord memory circuit 20, the circuit 21*a* and the comparator 22 of FIG. 7, and are also supplied to the accompaniment source circuit, thus generating the corresponding chords.

The signal RT1 representing the root previously stored in the chord memory circuit 20 is supplied to the circuit 21*a*, thus obtaining the root change signal DV1 from comparison between the signal RT1 and the current signal RT0.

The comparator 22 receives the signals RT1 and CD1 previously stored in the chord memory circuit 20 and the signals RT0 and CD0. When the previous signals RT1 and CD1 differ from the current signals RT0 and CD0, the comparator 22 supplies the "1" signal DF to the chord memory circuit 20 and the chord change memory circuit 25*a* and 25*b* so as to drive them. For this reason, the current chord signals RT0 and CD0 are received by the circuit 20 as the signals RT1 and CD1. The signal CD1 and the root change signal DV1 are received by the circuit 25*a* as signals KD2 and DV2. The signals KD2 and DV2 are received by the circuit 25*b* as signals KD3 and DV3. Signals CD1, DV2, KD2, DV3 and KD3 are supplied to the input terminals A1 to A5 of the chord comparator 24.

The chord memory circuit 23*a* receives the signals RT1 and CD1 and supplies them to the chord memory circuit 23*b* as the signals RT2 and CD2 every time the clock $\alpha$ is received for each measure. The circuit 23*b* also receives the clock $\alpha$ and the signals RT2 and CD2 are updated as the signals RT3 and CD3. This operation is repeated, and the root and the chord name of the seventh preceding chord from the current chord are stored in the chord memory circuit 23*f* so as to be generated as the signals RT7 and CD7. The signals RT7 and CD7 are supplied to the circuit 21*b* and the input terminal A7 of the comparator 24, respectively.

The root comparison calculation circuit 21*b* compares the roots of the updated current chord and the seventh preceding chord so as to obtain a difference DV7 therebetween and supplies it to the input terminal A6 of the chord comparator 24.

The chord comparator 24 compares the signals CD1, DV2, KD2, DV3, KD3, DV7, and CD7 at the input terminals A1 to A7 and the signal CPT at the input terminal B. When a coincidence therebetween is found, the comparator 24 generates the "1" coincidence signal SM so as to latch the count output of the counter 12 in the latch 13. Since the latch data is applied from the terminal S1 to S3 to the input terminals A6 to A8 of the rhythm pattern memory circuit 3 of FIG. 1 as the rhythm pattern selection signal, the fill-in or variation rhythm pattern is read out from the output terminals O1 to O8 of the circuit 3 instead of the normal rhythm pattern and is supplied to the rhythm source circuit 7 until the counter 2 of FIG. 1 generates the next carry signal $\alpha$ so as to reset the latch 13. During this interval, the fill-in or variation rhythm pattern is automatically generated instead of the normal rhythm pattern.

Operation of the chord change detector 6 will be described in more detail with reference to a particular chord change. As shown in FIG. 8, assume that Cmaj is designated at the first measure, and Emaj, Fmaj, G7, C7, D7, G7 and Cmaj are respectively designated at the second to eighth measures. The signals CD1, DV2, KD2, DV3, KD3, DV7, and CD7 supplied to the input terminals A1 to A7 are as shown in FIG. 9. Note that reference numeral (12) in FIG. 9 represents that the calculation is performed in duodecimal notation.

When the signals supplied to the input terminals A1 to A7 of the comparator 24 coincide with the pattern data CPT generated from the circuit 14, the "1" signal SM is generated from the comparator 24, and the latch 13 latches the current count output of the counter 12. Assume that the current count output of the counter 12 is "001". The data "001" is generated from the output terminals S3, S2 and S1 as the rhythm pattern selection signal and is supplied to the address input terminals A8, A7 and A6 of the rhythm pattern memory circuit 3 of FIG. 1. For this reason, the fill-in rhythm pattern is read out from the circuit 3 instead of the normal rhythm pattern.

It should be noted that in this embodiment, the degree of change in chord is detected in accordance with the current chord and the immediately preceding chord and the current chord and the twice-preceding chord. However, the present invention is not limited to this. The degree of change in chord can be detected in accordance with four or more chords or the current chord and the immediately preceding chord.

In this embodiment, a change in chord is detected as a degree of change in the root and type thereof, but can be the root of the chord and a degree of change in the type thereof.

As described above, an automatic rhythm pattern generator of an electronic musical instrument is provided in which the degree of change in the chord discrimination signals is sequentially detected in accordance with operation of an accompaniment keyboard so as to store it, a degree of change between the currently designated chord discrimination signal and the chord discrimination signal designated before a predetermined interval is detected, and a predetermined chord change pattern memory circuit is provided, so that a rhythm pattern can be switched in accordance with a change in chord. Therefore, the rhythm patterns can be naturally changed with a simple apparatus, thus achieving rhythmic performance.

What is claimed is:

1. An automatic rhythm generator for an electronic musical instrument, comprising: an accompaniment keyboard; a chord discrimination signal generator for generating a chord discrimination signal for a chord designated by said accompaniment keyboard; a first detecting means for detecting a first degree of change between the chord discrimination signal of the currently designated chord and a chord discrimination signal of an immediately preceding chord; first memory means for sequentially storing the data representing said first degree of change; a second detecting means for detecting a second degree of change between the chord discrimination signal of the currently designated chord and a chord discrimination signal of a chord designated before a predetermined time interval; second memory means for storing the data representing said second degree of change; a rhythm pattern change circuit for changing the rhythm pattern in accordance with memory contents of said first and second memory means; and means for producing rhythm tones in accordance with the rhythm pattern changed by said rhythm pattern change circuit.

2. An automatic rhythm generator according to claim 1, further comprising means for generating a plurality of chord change pattern data in accordance with the detected first and second degree of chord change.

3. An automatic rhythm generator for an electronic musical instrument, comprising:

an accompaniment keyboard;

a chord discrimination signal generator for generating multi-bit data representing a chord type and a root of a chord designated by said accompaniment keyboard;

detecting means for detecting a degree of change between roots of a currently designated chord and an immediately preceding chord, and the types of the currently designated chord and the immediately preceding chord;

memory means for sequentially storing data representing said degree of change detected by said detecting means;

rhythm pattern change circuit means for changing an accompaniment rhythm pattern in accordance with the contents of said memory means; and means for producing rhythm tones in accordance with the accompaniment rhythm pattern as changed by said rhythm pattern change circuit means.

4. An automatic rhythm generator according to claim 3, wherein said memory means includes; a chord memory for storing precedingly designated chord data; a chord comparison and calculation circuit for obtaining difference data between the precedingly designated chord data stored in said chord memory and the currently designated chord data; a chord change memory circuit for successively storing said difference data; means for driving said chord memory and chord change memory circuit when said difference data represents non-zero amount; and means for supplying an output of said chord change memory circuit to said rhythm pattern change circuit means.

5. An automatic rhythm generator according to claim 4, wherein said chord comparison and calculation circuit includes means for calculating a difference between two pitches of roots in successively obtained chord data; and said supplying means includes means for supplying bit data representing chord name in a successively obtained chord data, to a rhythm pattern switch circuit, together with said difference data.

6. An automatic rhythm generator according to claim 3, wherein said rhythm pattern change circuit means includes means for successively comparing memory contents of said memory means according to the progress of chord performance; means for outputting a rhythm pattern selection signal when a coincidence signal is outputted from said comparing means; and a rhythm pattern memory circuit arranged for access by said rhythm pattern selection signal.

7. An automatic rhythm generator according to claim 3, wherein said memory means includes a chord memory for storing precedingly designated chord data; a chord comparison and calculation circuit for obtaining difference data between the precedingly designated chord data stored in said chord memory and currently designated chord data; a chord change memory circuit for successively storing said difference data; means for driving said chord memory and chord change memory circuit according to the start of each measure; and means for supplying an output of said chord change memory circuit to said rhythm pattern change circuit means.

* * * * *

UNITED STATES PATENT AND TRADEMARK OFFICE

CERTIFICATE OF CORRECTION

PATENT NO. : 4,656,911

DATED : April 14, 1987

INVENTOR(S) : Keiichi SAKURAI

It is certified that error appears in the above-identified patent and that said Letters Patent is hereby corrected as shown below:

On the Title Page:

IN THE ABSTRACT, line 7, "same" should read -- name --.

Signed and Sealed this

Fifth Day of April, 1988

*Attest:*

DONALD J. QUIGG

*Attesting Officer*

*Commissioner of Patents and Trademarks*